US007494395B2

(12) United States Patent
Krikliwy et al.

(10) Patent No.: US 7,494,395 B2
(45) Date of Patent: Feb. 24, 2009

(54) HAND PADDLE

(76) Inventors: Sergei Krikliwy, 449 S. Stratford Dr., Tucson, AZ (US) 85716; Alexander Sergeivitch Krikliwy, 449 S. Stratford Dr., Tucson, AZ (US) 85716

( * ) Notice: Subject to any disclaimer, the term of this patent is extended or adjusted under 35 U.S.C. 154(b) by 0 days.

(21) Appl. No.: 12/071,548

(22) Filed: Feb. 22, 2008

(65) Prior Publication Data

US 2008/0214073 A1 Sep. 4, 2008

(51) Int. Cl.
*A63B 31/10* (2006.01)

(52) U.S. Cl. ..... 441/56

(58) Field of Classification Search ..... 441/56, 441/57, 58

See application file for complete search history.

(56) References Cited

U.S. PATENT DOCUMENTS

| | | | |
|---|---|---|---|
| 183,045 | A | 10/1876 | Dunlop |
| 216,455 | A | 6/1879 | Primbs |
| 545,706 | A | 9/1895 | Mannes |
| 894,311 | A | 7/1908 | Brenton |
| 950,633 | A | 3/1910 | Eastman |
| 1,371,708 | A | 3/1921 | Schreiner |
| 1,535,896 | A | 4/1925 | Bociek |
| 1,558,666 | A | 10/1925 | Brewer et al. |
| 1,621,693 | A | 3/1927 | Theobold |
| 1,625,730 | A | 4/1927 | Lake |
| 1,726,728 | A | 9/1929 | Adams |
| 1,754,704 | A | 4/1930 | Wilcox |
| 1,786,451 | A | 12/1930 | Ribard |
| 1,821,974 | A | 9/1931 | Leblanc |
| 1,930,281 | A | 10/1933 | Ogden |
| 1,971,844 | A | 8/1934 | Babbitt |
| 2,006,915 | A | 7/1935 | Ferber |
| 2,017,463 | A | 10/1935 | Komadina |
| 2,109,429 | A | 2/1938 | Malm |
| 2,159,972 | A | 5/1939 | Larson |
| 2,188,343 | A | 1/1940 | Flournoy |
| 2,227,825 | A | 5/1941 | Devermann |
| 2,313,979 | A | 3/1943 | Tuma |
| 2,389,196 | A | 11/1945 | Harmon |
| 2,555,969 | A | 6/1951 | Holcombe |
| 2,556,894 | A | 6/1951 | Axiotes |
| 2,745,119 | A | 5/1956 | Whipple |
| 2,771,618 | A | 11/1956 | Crum |
| 2,893,021 | A | 7/1959 | Lundborg |
| 2,987,316 | A | 6/1961 | Butera |
| 3,039,120 | A | 6/1962 | Powell et al. |
| 3,063,070 | A | 11/1962 | Nichol |
| 3,109,184 | A | 11/1963 | Moore, Jr. |
| 3,117,325 | A | 1/1964 | Shelton |

(Continued)

*Primary Examiner*—Lars A Olson

(57) ABSTRACT

This invention is intended as an improved swimming aid for the hand. It is a ridged paddle having several features to enhance the paddles' performance for enjoyable swimming. The paddle has a finger tip hood that permits the fingers to extend unobstructed through finger facing apertures. The paddle has a wrist portion having a wrist strap. A thumb notch formed at a lateral end, by the palm potion of the paddle. The palm portion has a Transverse Ridge, that together with two lateral flanks form a triangle of three major bends at the palm. And, with two bends for the finger apertures and finger tip hood, change the paddles' shape from a flat surface to a three dimensional form, that deflect water, adds structural strength, and aids in hand comfort. The arrangement of these features, provide an enjoyable instrument that facilitates good leverage in the water.

2 Claims, 5 Drawing Sheets

U.S. PATENT DOCUMENTS

| | | | |
|---|---|---|---|
| 3,153,797 | A | 10/1964 | Drennen, Jr. |
| 3,174,167 | A | 3/1965 | Pauley |
| 3,182,657 | A | 5/1965 | Zurbuchen |
| 3,286,287 | A | 11/1966 | Martin |
| 3,328,812 | A | 7/1967 | Berthiot |
| 3,397,414 | A | 8/1968 | Webb |
| 3,407,419 | A | 10/1968 | Drummond |
| 3,417,415 | A | 12/1968 | Kozak |
| 3,518,024 | A | 6/1970 | Wilson |
| 3,529,313 | A | 9/1970 | Girden |
| 3,765,042 | A | 10/1973 | Montrella |
| 3,786,526 | A | 1/1974 | Ausseil |
| 3,922,740 | A | 12/1975 | Potter |
| RE28,855 | E | 6/1976 | Montrella |
| 4,129,912 | A | 12/1978 | Robinson |
| D256,938 | S | 9/1980 | Castelli |
| D256,939 | S | 9/1980 | Castelli |
| 4,227,692 | A | 10/1980 | Castelli |
| 4,233,925 | A | 11/1980 | Proctor |
| D257,867 | S | 1/1981 | Castelli |
| D262,477 | S | 12/1981 | Lewis |
| 4,316,300 | A | 2/1982 | Lewis |
| 4,493,663 | A | 1/1985 | Richmond |
| 4,509,744 | A | 4/1985 | Beasley |
| 4,516,774 | A | 5/1985 | Nankivell |
| 4,521,011 | A | 6/1985 | Solloway |
| 4,674,110 | A | 6/1987 | Eaton et al. |
| 4,721,300 | A | 1/1988 | Guzman |
| 4,832,643 | A | 5/1989 | Schoofs |
| 4,913,418 | A | 4/1990 | Schlueter et al. |
| 4,932,911 | A | 6/1990 | Albrecht |
| 4,964,824 | A | 10/1990 | Spencer et al. |
| 5,018,732 | A | 5/1991 | Kraemer et al. |
| 5,147,233 | A | 9/1992 | Hannula |
| 5,236,191 | A | 8/1993 | Capriati |
| 5,261,673 | A | 11/1993 | Miller |
| 5,288,254 | A | 2/1994 | Elson |
| 5,304,080 | A | 4/1994 | Dilger |
| 5,376,036 | A | 12/1994 | Hull |
| 5,378,217 | A | 1/1995 | D'Orta |
| D363,754 | S | 10/1995 | Johnson |
| 5,511,998 | A | 4/1996 | Johnson |
| 5,516,319 | A | 5/1996 | Nessel |
| 5,549,294 | A | 8/1996 | Wellen et al. |
| D378,307 | S | 3/1997 | Desveaux |
| 5,643,027 | A | 7/1997 | Evans et al. |
| 5,647,783 | A | 7/1997 | Nessel |
| 5,651,710 | A | 7/1997 | Rives et al. |
| 5,658,224 | A | 8/1997 | Betrock |
| D397,187 | S | 8/1998 | Reeder |
| 5,795,201 | A | 8/1998 | Tibbetts |
| 5,842,896 | A | 12/1998 | Liveoak |
| 6,019,650 | A | 2/2000 | Rives et al. |
| 6,183,396 | B1 | 2/2001 | Reynier |
| 6,398,603 | B1 | 6/2002 | Brown |
| 7,179,146 | B2 | 2/2007 | Johnson |

HAND PADDLE

FIELD OF THE INVENTION

The invention relates generally to hand paddles for swimming.

BACKGROUND OF THE INVENTION

Swimming aids such as hand paddles are used for swimming faster, or as endurance training aids. In the majority of hand paddle designs which have been attempted, the blade consists of a flat planar member roughly in the outline of a hand and having a strap or brace on one side of the blade to accommodate the hand. For example, U.S. Pat. No. 894,311 to Brenton, U.S. Pat. No. 2,389,196 to Harmon, U.S. Pat. No. 2,555,969 to Holcombe, U.S. Pat. No. 3,765,042 to Montrella, U.S. Pat. No. 3,922,740 to Potter, U.S. Pat. No. 4,913,418 to Schlueter et al., U.S. Pat. No. 5,288,254 to Elson, U.S. Pat. No. 5,511,998 to Johnson, U.S. Pat. No. 5,651,710 to Rives et al., and U.S. Pat. No. 6,019,650 to Rives et al. and many others all disclose swim paddles having flat planar swim blades with one or more straps for securing the paddle to the hand. Other swim paddles use a flat planar blade having a plurality of apertures configured to permit the swimmer to grasp onto the blade by passing the fingers through the apertures to facilitate a grip of the paddle. U.S. Pat. No. 2,745,119 to Whipple and U.S. Pat. No. 3,397,414 to Webb are examples to this application of design. Yet another design for swimming hand paddles consist of a flat blade having an integral hand grip permitting the swimmer to grip onto the paddle by grasping the hand grip. U.S. Pat. No. 4,233,925 to Proctor, U.S. Pat. No. 4,493,662 to Richmond and U.S. Pat. No. 6,398,603 to Brown are examples of this later design.

The prior art for hand paddles all permit the swimmer to apply greater force to their swimming strokes. However, they encounter problems, such as, flutter, wobble, water shear and hand fatigue. As a flat planar paddle is forced through the water by a swimmer, the paddle will tend to flutter (movement at sides) or wobble (movement between hand and paddle), thus causing the swimmer to expend energy by holding his hand steady through the stroke. A fluttering motion experienced by flat planar swimming paddles may cause the swimmer to loose his or her control of the paddle. As a result, the swimmer must tighten his or her grip on the paddle in order to keep the paddle in control during the stroke. A tighter grip creates increased fatigue and muscle strain for the swimmer. Besides, maintaining the hand in a flat position with the fingers outstretched against a flat surface for long periods of time, results in increased hand strain and hand fatigue.

Swimming paddles having concaved shapes have been attempted. These paddles usually include a blade having a concave surface on the waterside, and a hand holding aid, such as a hand strap, on the other side. U.S. Pat. No. 950,633 to Eastman, U.S. Pat. No. 2,159,972 to Larson and U.S. Pat. No. 183,045 to Dunlop and U.S. Pat. No. 5,643,027 to Evans et al. are examples of this type of design. These swim paddles consist of a flat member having a concave surface on one side, a convex surface on the opposite side, and a hand strap being incorporated on the convex side. These designs have the advantage of permitting the swimmer to place the hand on the paddle in a comfortable manner. However, concave paddle designs also suffer from the problems associated with paddle flutter and water shear. Indeed, these concave designs often suffer from increased flutter and water shear due to turbulence created by the concave surface impinging on the water.

SUMMARY OF THE INVENTION

The present invention provides a hand swimming paddle with features to overcome drawbacks of the prior art, such as flutter, wobble, water shear, structural strength, and hand strain to enhance the blades' fluid dynamics for maneuverability. The improved hand paddle is a ridged blade having a hand side opposite to the waterside, a proximal end opposite the distal end, and opposite first and second lateral ends. Two lateral flanks, a wrist portion, a palm portion, a thumb notch, an inter digital portion, finger apertures and a finger tip hood are shaped and configured to achieve an improvement.

First and Second flanks are formed on the first and second lateral ends, respectively. The flanks are bent upward from the waterside towards the hand side of the blade. The first flank extends from the proximal end to the thumb notch in the blade. The second flank extends from proximal end to the little finger aperture. A wrist portion on the proximal end takes on the shape of a V-shaped wedge between the two flanks at the lateral ends to receive the hand at the wrist.

A palm portion in the center of the blade takes a major bend aiding in hand comfort and fluid dynamics. A thumb notch at the palm portion adds to a good grip. An inter digital portion where the finger apertures are formed takes a bend to position the apertures to face the fingers. Another bend at the top of the finger apertures, align the finger tip hood above and parallel to the finger tips, allowing the fingers to pass through the apertures unobstructed, and secure the blade firmly while swimming.

With the foregoing in view, advantages will become apparent to which this invention relates to. The invention is further described by reference to the accompanying drawings, which includes a description of the embodiment for the principles of the present invention.

DESCRIPTION OF THE DRAWINGS

In the drawings, numbers of reference indicate corresponding parts in the different figures.

DETAILED DESCRIPTION OF THE INVENTION

Figure 1:
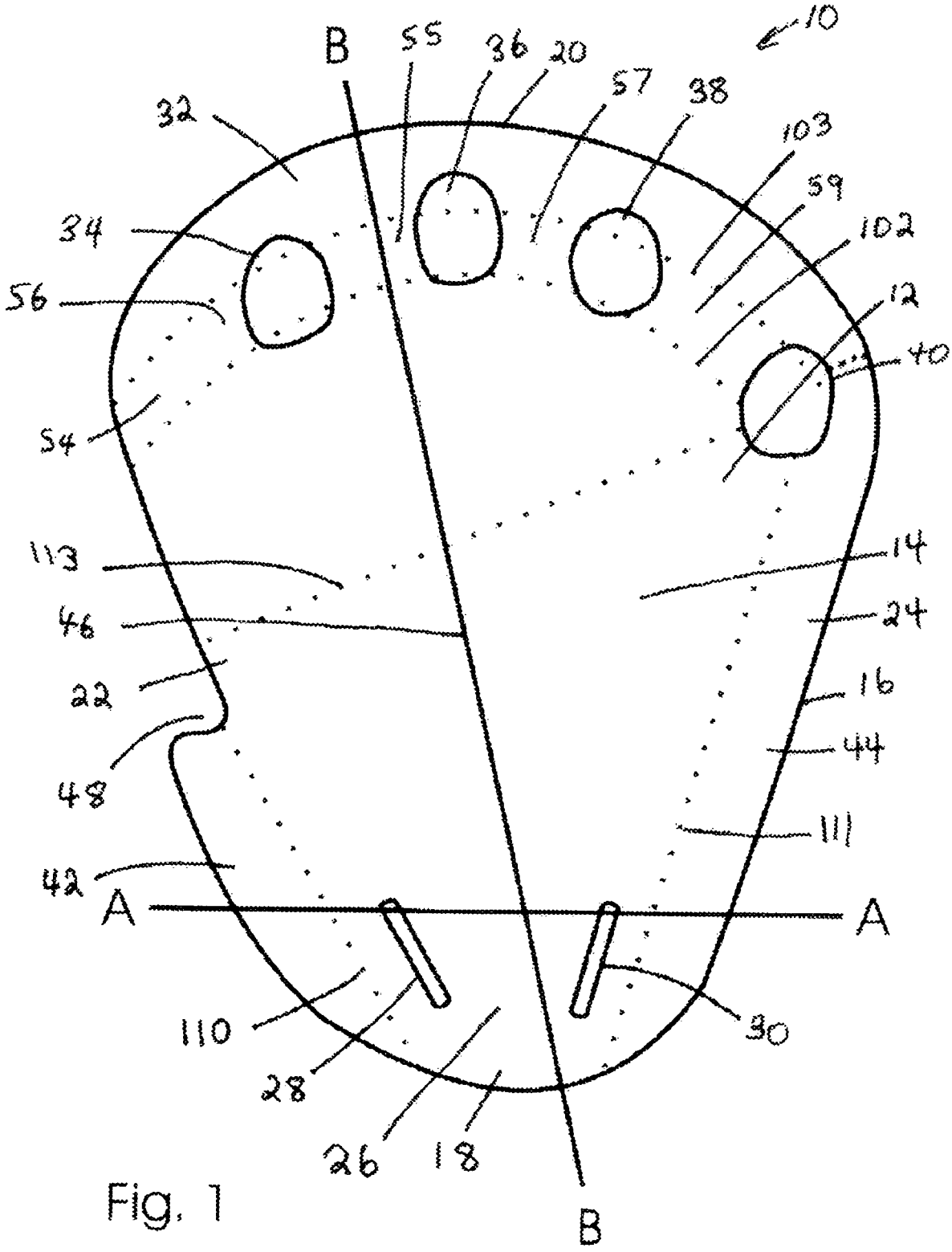
FIG. 1. is a top view of a right hand swim paddle made in accordance with the invention.
Figure 3:
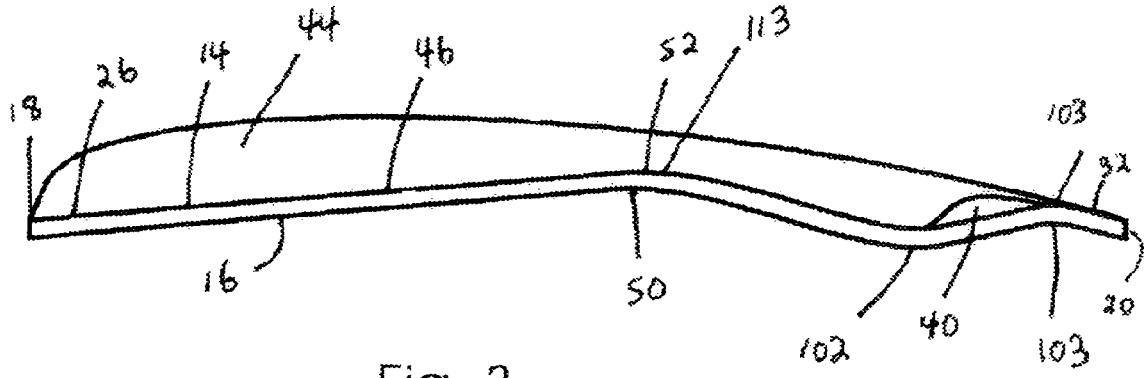
FIG. 3. is a sectional view of the swim paddle shown in FIG. 1, taken along line B-B.
Figure 4:
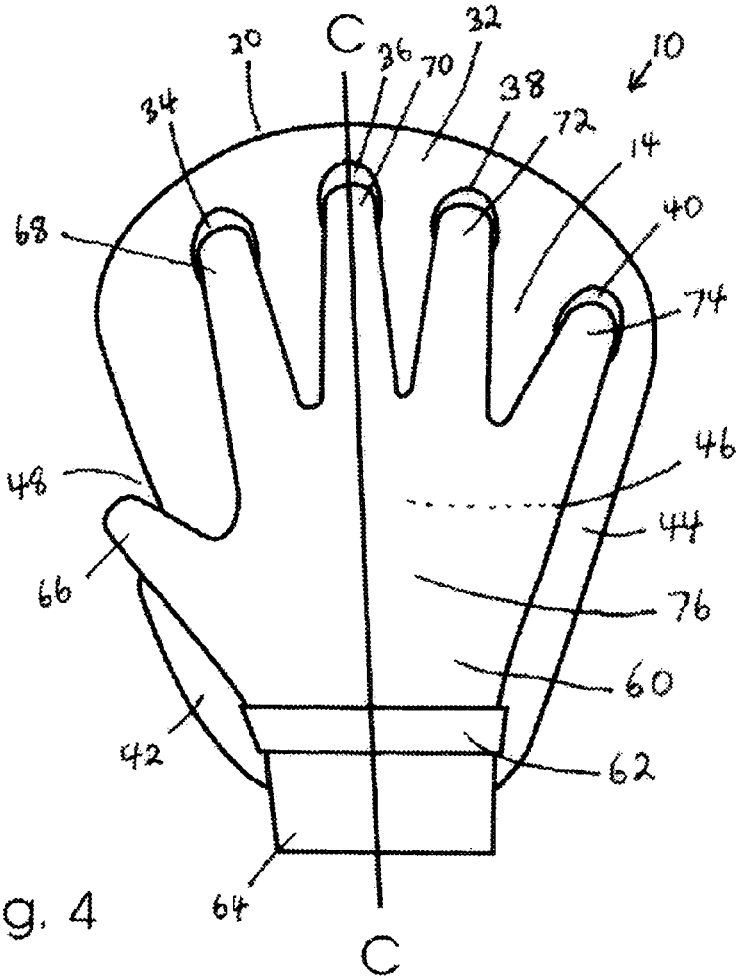
FIG. 4. is a top view of a right hand swim paddle shown in FIG. 1, made in accordance with the invention being worn by the hand.

Referring to FIGS. 1,3. A swim paddle made in accordance with the invention for use on the right hand is shown as item 10. The present invention is directed towards swim paddles for use with both the right and left hand. A swim paddle made in accordance with the present invention for use with the left hand, would be a mirror copy of paddle 10, and would have all of the features of the paddle shown in FIG. 1. Paddle 10 consists of: a ridged blade 12, having a hand side 14, and a waterside 16, which is the opposite side to the hand side. A proximal end 18, where the blade begins at the wrist portion of the hand. A distal end 20, opposite the proximal end, where the blade ends at the finger tips of the hand. A first lateral end 22, is at the thumb side of the blade, and a second lateral end 24, is at the little finger side of the blade. The outlined shape of the blade is a symmetrical outline of the human hand held with fingers spread open in a comfortable position, not stretched, because this would cause fatigue. From this outline in a flat form sheet metal or plastic, features are created to make this swim paddle unique. These features are now discussed.

Figure 2:
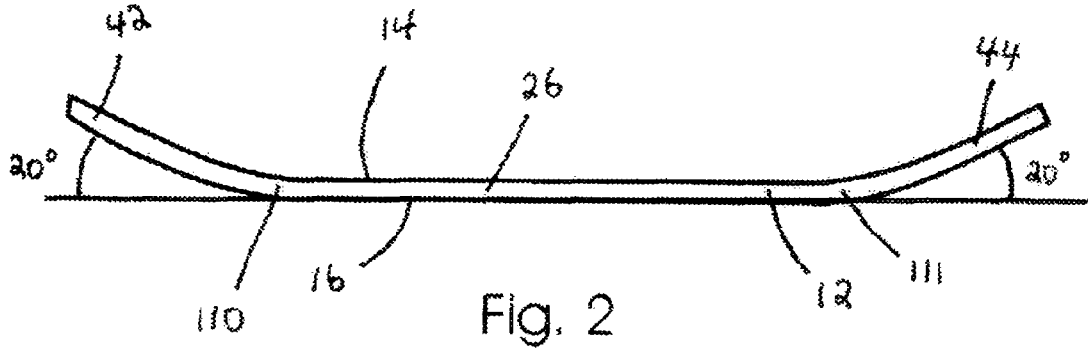
FIG. 2. is a sectional view of the swim paddle shown in FIG. 1, taken along line A-A.

First and Second Flanks 42, and 44, FIGS. 1, 2, 3, 4, 5, are formed from the first and second lateral ends 22, and 24, of the blade respectively. The flanks 42, and 44, extend from bends 110, and 111, to the lateral ends 22, and 24 of the blade respectively. The first flank 42, extends from the thumb notch 48, to the proximal end 18, in a straight line. The second flank 44, extends from the proximal end 18 in a straight line, to the little finger aperture 40, continuing through the aperture, to the finger tip hood 32, at bend 103. Bend 111, which creates flank 44, flattens at the top of the little finger aperture 40. At this point flank 44, ends by taking a turn to become part of the finger tip hood 32. Flanks 42, and 44, are approximately one inch in width, and angled upward at approximately 20 degrees. As seen in FIG. 2, first flank 42, and second flank 44, are bent upward from waterside 16, towards hand side 14, such that the flanks extend upward to form an upward V-shaped wrist portion 26, between the flanks. The significance of flanks 42, and 44, are threefold: 1. Bends 110, and 111, in the flat blade form upward flanks 42, and 44, that add structural strength to the blade, making it rigid and three dimensioned, so that the blade will not bend or wobble when in use. 2. The flanks 42 and 44, help to deflect water, eliminating flutter and water shear. 3. Flanks 42, and 44, allow for smoother water disbursement, to permit the swimmer to control the blade, as it is forced through the water, this aids in hand comfort and security for the palm, resulting in less hand strain.

A wrist portion 26, FIGS. 1, 2, 3, 4, 5. is formed and dimensioned for the lower palm of the hand that meets the wrist. It forms an upward V-shaped wedge at the proximal end 18, to receive the hand at the wrist 64, of the right hand. Slits 28, and 30, are formed and positioned on the wrist portion 26, to accommodate a wrist strap 62, to secure the blade to the wrist. The significance of the upward V-shaped wedge are twofold: 1. Flanks 42, and 44, form the upward V-shaped wedge that deflect water at the lateral ends, along the sides of the hand, resulting in less hand strain. 2. Flanks 42, and 44, aids in hand comfort and security for the palm of the hand.

A Palm portion 46, FIGS. 1, 3, 4, 5, is located in the center of blade 12, between the wrist portion 26, the Inter digital portion 56, and the first and second lateral ends 22, and 24. And, has a central bend 113, that runs in a straight line from the center of the little finger aperture 40, to approximately one inch above the thumb notch 48, at the first lateral end 22. Bend 113, forms a Transverse Ridge 52, on the hand side 14, and a hollow V-shaped wedge 50, on the waterside 16, of blade 12. The significance of Bend 113, are six fold: 1. Bend 113 is crucial, because the Transverse Fasciculi, which is the meaty portion on the palm of the hand, that is just below where the fingers meet the palm, rests upon ridge 52, which is formed by bend 113. Ridge 52, offers an arched support for a relaxed position, allowing the fingers to bend down, forming a slight cup in the hand for comfort. 2. Ridge 52, conveniently positions the fingers for the finger apertures 34, 36, 38, 40. 3. Ridge 52, forms a line of central force that is applied by the meaty portion of the palm, to blade 12. Because, this is the central part of the hand that manipulates the entire movement of blade 12. 4. On the waterside 16, of blade 12, ridge 52, creates a hollow V-shaped wedge 50, that runs from one inch above the thumb notch 48, at the first lateral end 22, to the center of the little finger aperture 40, situated close to the second lateral end 24. This allows for water disbursement to the lateral ends 22, and 24, reducing water pressure to reduce flutter and water shear. 5. Ridge 52, adds structural strength to make blade 12, ridged, to eliminate wobble between blade 12, and the hand. 6. Ridge 52, is set along the meaty portion of the palm, where the fingers meet the palm of the hand. This forms a line of central force that is at an angle to the perpendicular of blade 12. Because, this part of the human hand is angled to the perpendicular. Therefore, bend 113, adds a slight twist to blade 12, which causes a steeper slope at the first lateral end 22, and a slight slope at the second lateral end 24. Thus creating a deeper and wider hollow V-shaped wedge 50, at the first lateral end 22, and a narrower and shallower hollow V-shaped wedge 50, at the little finger aperture 40, close to the second lateral end 24, on the waterside 16. This configuration of blade 12, makes it a custom fit to the hand, just as a base ball glove does, making blade 12, unique.

A thumb notch 48, FIGS. 1, 4, 6, 7, for the thumb is provided at a convenient location at the first lateral end 22, of the blade to accommodate the thumb. Since the thumb is situated at the side of the hand, it is convenient to provide a notch 48, at the first lateral end 22, for the thumb to fit into, and hold the blade securely when the fingers are engaged in the finger apertures 34, 36, 38, and 40. From this configuration a secure grip is obtained.

Figure 5:
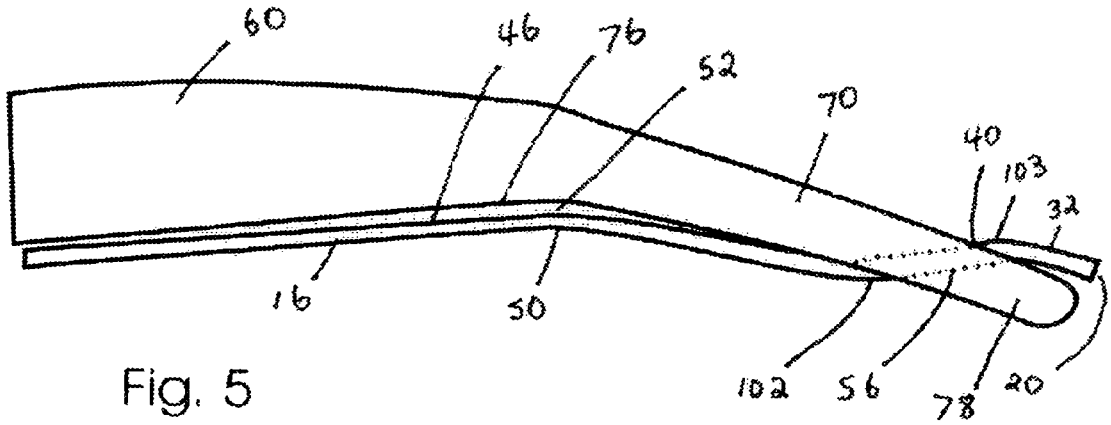
FIG. 5 is a sectional view of the swim paddle shown in FIG. 4, taken along line C-C, from FIG. 4.

An inter digital portion 56, FIGS. 1, 3, 5 is located between the palm portion 46, and finger tip hood 32. It is the area of the blade that includes the Finger Apertures 34, 36, 38, 40, and the Inter Digital Portions 54, 55, 57, 59, which are the spaces between the finger apertures 34, 36, 38, 40. The Apertures for the fingers are dimensioned and positioned in inter digital portion 56, as shown in FIGS. 1, 3, 5, 6, 7. Inter digital portions 54, 55, 57, 59, are bent upward at an angle approximately 30 degrees toward the hand side 14, of blade 12, by bend 102. Bend 102, runs from the first lateral end 22, to the little finger aperture 40, along the bottom of the finger apertures 34, 36, 38, 40, which are at a convenient location to meet the first knuckle of each finger respectively. Bend 102, repositions inter digital portion 56, upward, to position the finger apertures 34, 36, 38, 40, to face the fingers of the hand, so that the fingers may enter the apertures unobstructed, and continue to remain straight, or curl slightly at the finger tips, or curl completely at the tips, depending upon the swimmers' disposition at the time of use. The significance of the angulation for the finger apertures are threefold: 1. The finger apertures are repositioned for the fingers to enter the apertures without bending for hand comfort. This allows the hand to remain in a comfortable position, to reduce hand strain and increase maneuverability. Because, the fingers can be held in any position; straight, tips curled slightly, or tips curled completely to hold the blade firmly at any time as need be. 2. The angulation created by bend 102, adds structural strength to eliminate bending or wobble by the blade when in use. 3. The angulation allows for water deflection, to improve water disbursement, to reduce water pressure for a smoother hand stroke.

A finger tip hood 32, FIGS. 1, 3, 5, is positioned and formed by bend 103, at the top of inter digital portion 56, that extends from the top of finger apertures 34, 36, 38, 40, to the distal end 20, at the finger tips. The distal end 20, becomes part of the finger tip hood 32. Bend 103, runs along the top parts of inter digital portions 54, 55, 57, 59, along the top parts of the finger apertures 34, 36, 38, 40, across blade 12, from the first lateral end 22, to second lateral end 24. Bend 103, forms and position the finger tip hood 32, forward from the hand side 14, toward the waterside 16, of the blade, placing the finger tip hood 32, at a position above and parallel to the finger tips of the hand, when the fingers are outstretched through the finger apertures 34, 36, 38, 40. The significance of the finger tip hood 32, are threefold: 1. By raising the finger tip hood 32, the fingers are able to enter the finger facing apertures and remain straight, curled slightly at the finger tips, or curled completely at the tips. This is made possible because, this part of the blade, the distal end, no longer obstructs the fingers. This aids in hand comfort and blade control. 2. Bend 103, raises the finger tip hood 32, to extend above and parallel to the tips of the fingers, thereby maintaining size and the desired thrust to propel the swimmer through the water. 3. The finger tip hood 32, aids in finger tip comfort, and security for the finger tips.

Figure 6:
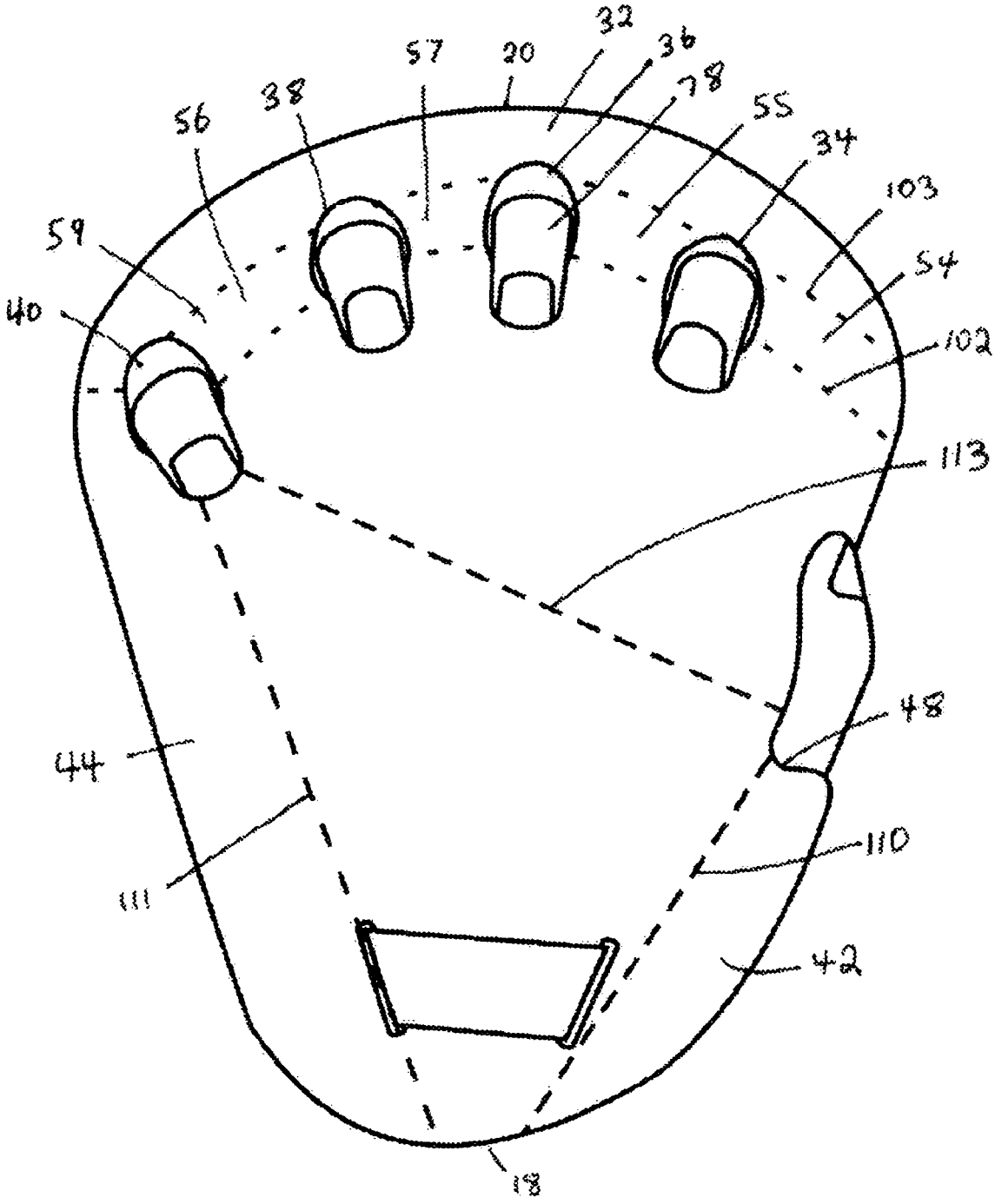
FIG. 6 is a bottom view of right hand swim paddle shown in FIG. 4, made in accordance with the invention being worn by hand with the fingers curled, to hold the blade firmly.
Figure 7:
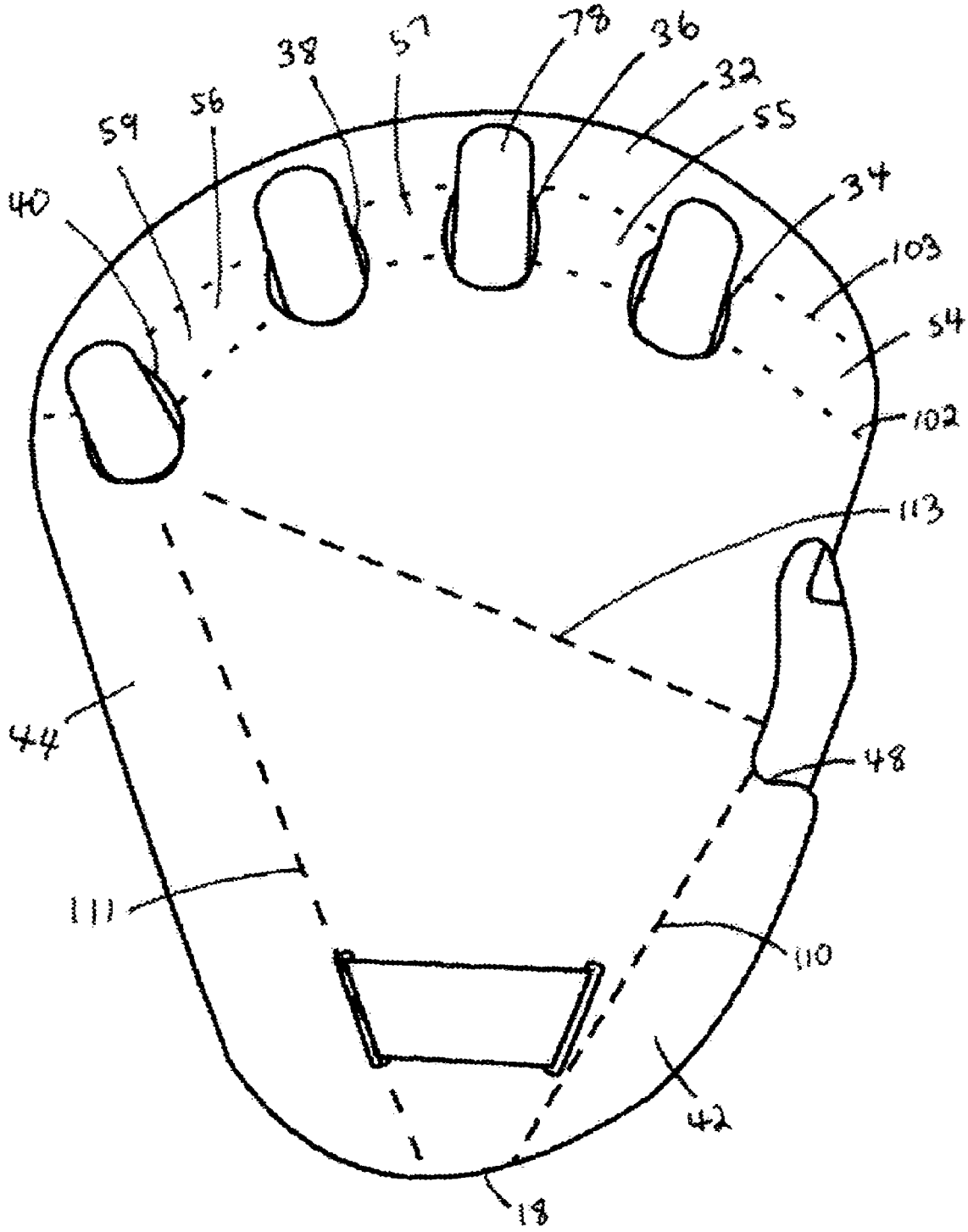
FIG. 7 is a bottom view of the right hand swim paddle shown in FIG. 6, made in accordance with the invention being worn on the hand with the fingers extended, in a relaxed position.

Referring to FIGS. 4, 5, 6, 7, when using swim paddle 10, the swimmer places his hand 60, on hand side 14, of the paddle, and inserts his fingers 68, 70, 72, 74, through apertures 34, 36, 38, 40, respectively, and with thumb 66, on thumb notch 48. The wrist strap 62, is then engaged to secure the wrist 64, to the blade. The palm of the hand 76, rests on palm portion 46, of the blade, with flank 42, and flank 44, running along the sides of the hand. As seen in FIGS. 6, and 7. The swimmer may hold onto blade 12, by curling finger tips 78, through the finger apertures to grip the blade firmly as shown in FIG. 6, or by extending finger tips 78, for comfort, as shown in FIG. 7. In FIG. 5, the upward bend 102, for inter digital portion 56, and the forward bend 103, for finger tip hood 32, permit finger tips 78, to extend unobstructed through the finger apertures 34, 36, 38, 40. With this arrangement, the fingers can be stretched without constriction, while wearing the blade. Thus, the hand is in a comfortable position, thereby decreasing muscle strain on the hand.

In essence, by placing two bends at the inter digital portion, and a triangle of three bends at the palm portion of the blade, changes its shape to make it a three dimensional ridged form, that give the blade three important features: Structural Strength, Water Deflection and Hand Comfort. Which aids in blade control, while dealing with the fluid mechanics for maneuverability.

The methods for manufacturing the swim paddle in accordance with this invention are:

1. For the embodiment of the invention, a foam is injected into a reactive molding machine to form the paddle blade (12) in one operation. The preferred design is molded using conventional injection molding to attain between 2-5 mm thickness of copolymers and other mixes to produce the desired properties.
2. Another method for production is to stamp out sheet metal, producing formed paddles in one operation.

The embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

We claim:

1. A hand paddle comprising:

(a) a palm portion located in a center of the hand paddle between a wrist portion, a plurality of inter digital portions, and a first lateral end and a second lateral end, the palm portion has a central bend that runs in a straight line from a center of a little finger aperture to approximately one inch above a thumb notch at the first lateral end;

(b) a first flank formed by an upward bend along the first lateral end;

(c) a second flank formed by an upward bend along the second lateral end;

(d) a finger tip hood at the distal end, formed and positioned by a bend that runs from the first lateral end to the second lateral end along the top of the finger apertures to position the finger tip hood, forward from a hand side toward a waterside of the hand paddle, such that the finger tip hood is placed above and parallel to finger tips of a hand when fingers are out stretched through the finger apertures, the finger tip hood being elevated allows the fingers to protrude through the finger apertures unobstructed;

wherein the central bend:

i) runs on the palm portion on the hand side and across the hand paddle from the center of the little finger aperture situated close to the second lateral end, to approximately one inch above the thumb notch at the first lateral end;

ii) causes the finger portion of the hand paddle to slope down, to allow the fingers to bend, forming a slight cup in the hand for comfort;

iii) is at a slight angle to the perpendicular of the hand paddle, therefore it gives the finger portion a slight twist, adding to hand comfort iv) forms a transverse ridge, a Transverse Fasciculi (or meaty portion of the palm that is just below where the fingers meet the hand rest upon the transverse ridge, on a waterside of the hand paddle the transverse ridge formed by the central bend forms a hollow V-shaped wedge that allows for water disbursement to the lateral ends which alleviates water pressure while adding structural strength, to eliminate wobble, flutter, water shear, buckling, or bending of the hand paddle wherein the plurality of inter digital portions are bent upward at an angle approximately 30 degrees toward a hand side of the hand paddle by a bend that:

i) runs from the first lateral end to the little finger aperture, along the bottom of a plurality of finger apertures which are at a convenient location to meet a first knuckle of each finger respectively, ii) repositions the inter digital portions upward to position the finger apertures to face the fingers of the hand, so that the fingers may enter the apertures unobstructed, and continue to remain straight, or curl slightly at the finger tips, or curl completely, depending upon a swimmer's disposition at time of use;

wherein the inter digital portions further comprises three additional finger apertures in addition to the little finger aperture.

2. The hand paddle of claim 1 further comprising a pair of slits, the slits are formed and positioned on the wrist portion to accommodate a wrist strap to secure the hand paddle to the wrist.

* * * * *